United States Patent [19]

Benda et al.

[11] 3,961,221

[45] June 1, 1976

[54] ELONGATED GETTER SUPPORT FOR CATHODE RAY TUBE HAVING ROTATABLE MEMBER AT END

[75] Inventors: David Benda, Geneva; Charles Alfred Davis, Auburn, both of N.Y.

[73] Assignee: GTE Sylvania Incorporated, Stamford, Conn.

[22] Filed: June 12, 1975

[21] Appl. No.: 586,194

[52] U.S. Cl. ..... 313/481; 313/178

[51] Int. Cl.[2] ..... H01J 29/94; H01K 1/52

[58] Field of Search ..... 313/481, 178, 174

[56] References Cited

UNITED STATES PATENTS 3,508,105 4/1970 Pappadis ..... 313/178

*Primary Examiner*—Robert Segal

*Attorney, Agent, or Firm*—Norman O'Malley; Frederick H. Rinn; Robert T. Orner

[57] ABSTRACT

Improved means are provided for supporting a container of effusive material within a cathode ray tube wherein the container is located at the terminal end of a resilient longitudinal positioning member attached to the electron gun assembly. The supportive means includes at least one support placement means which projects forwardly from the container as a directional continuation of the positioning member. Associated with the support placement means is a rotatable member, the peripheral surface of which tracks in a direction common with the directional trend of the positioning member. The rotatable member, which may be formed of insulative material, effects facile positioning with a minimum of abrasion and positive spatial supportive placement of the container relative to the wall of the envelope.

8 Claims, 6 Drawing Figures

ELONGATED GETTER SUPPORT FOR CATHODE RAY TUBE HAVING ROTATABLE MEMBER AT END

BACKGROUND OF THE INVENTION

This invention relates to cathode ray tube effusive material structures and more particularly to insulative means for supporting a container of effusive material within a cathode ray tube.

In cathode ray tubes of the type conventionally employed in image display applications, at least one effusive material structure, as for example, a getter, is affixed to the forward end of the electron generating means oriented within the neck portion of the tube envelope. An exemplary type of getter structure is one referenced within the art as an antenna getter. This type of structure is usually comprised of a resilient longitudinal positioning member or wand having a curvature therein and a getter container terminally mounted thereon. These antenna-type structures are usually affixed to the terminal portion of the electron gun or generating means in an outward curving manner prior to positioning of the gun assembly within the restrictive neck portion of the tube envelope. The curved resilient positioning member permits flexure thereof to facilitate insertion of the electron gun assembly into the neck portion, while assuring sequential orientation of the forward-extending getter container in a position closely adjacent to the interior surface of the outwardly flared infundibular portion of the tube envelope, outside of the paths of the projected electron beams proximal thereto.

It is conventional practice in the art to coat the interior surface of the funnel portion of the tube envelope, and the forward area of the integral neck portion thereof, with an electrical conductive coating such as Aquadag or graphite. In some tube constructions, bands or areas of resistive coating are also disposed upon the interior surface of the funnel portion in an adjacent or continuous relationship to the conductive coating disposed thereon. Usually associated with the forwardly oriented getter container are skid or sled-like metallic means which facilitate positioning the getter container in spatial relationship with the interior surface of the funnel. Upon inserting the electron gun into the open neck of the tube, the aforementioned sled means of the outwardly-extending getter structure, makes contact with the wall of the neck, and as the insertion-positioning of the electron gun progresses, the forwardly oriented sled means on the getter structure scrapes or slides along the interior surface of the neck portion continuing into the funnel portion of the envelope. While the funnel disposed coatings are conventionally formulated to evidence hard surface characteristics, such pressured contact is sometimes conducive for scraping off particles of the conductive or resistive coatings over which the sled may pass. Such loosened coating materials, being residual within the interior of the tube, become deleterious factors affecting the ultimate quality of the tube. In addition, the aforedescribed antenna getter structure forms a metallic bridge which effects shorting out the electron gun assembly to the internal conductive and/or resistive coatings within the tube. There are occasions, especially when discretely oriented resistive coatings are employed, that a shorting effect to the gun structure is an undesirable condition.

OBJECTS AND SUMMARY OF THE INVENTION

It is an object of the invention to reduce the aforementioned disadvantages of the prior art. Another object is to provide improved means for supporting a container of effusive material in an insulative manner within a cathode ray tube. A further object is the provision of support means for a container of effusive material within a cathode ray tube that minimizes abrasion of the coatings on the interior surface of the tube during positioning therein.

These and other objects and advantages are achieved in one aspect of the invention as improved means for supporting a container of effusive material within a cathode ray tube wherein the container is located at the terminal end of a resilient antenna-type longitudinal positioning member which is affixed to the forward region of an electron gun assembly. Positioning of the gun within the neck portion of the envelope effects orientation of the container within the envelopic enclosure in spatial relationship to the wall of the funnel portion thereof. The improved supportive means includes at least one support placement means which projects forwardly from the container as a directional continuation of the positioning member. This support placement means has a rod-like axial portion formed normal to the directional orientation of the positioning member and oriented in a plane related to the bottom of the container. At least one rotatable member is positioned on the axle portion in a manner to turn freely thereabout. This rotatable means has a peripheral surface which enables tracking of the member, with a minimum of abrasion, in a direction common with the directional trend of the positioning member. Functionally, the rotatable member which may be formed of insulative material, beneficially effects facile positioning and positive spatial supportive placement of the container relative to the wall of the envelope. When the rotatable member is formed of insulative material it provides electrical isolation of the container and positioning structure from the one or more coatings disposed on the interior wall of the envelope.

DETAILED DESCRIPTION OF THE PREFERRED EMBODIMENT

For a better understanding of the present invention, together with other and further objects, advantages and capabilities thereof, reference is made to the following specification and appended claims in connection with the aforedescribed drawings.

The supportive structure of the invention, as described herein, is adaptable to supporting various types of containers of effusive materials, such as those supplying gettering gas-adsorbing substances, givers of selected gasses or metallic depositions. Thus, the scope of the invention represents sufficient generic breadth to include the accommodation of any vaporizable or effusive material that may be desirably disposed within the tube. For purposes of example, the support of a gettering structure will be described herein.

Figure 1:
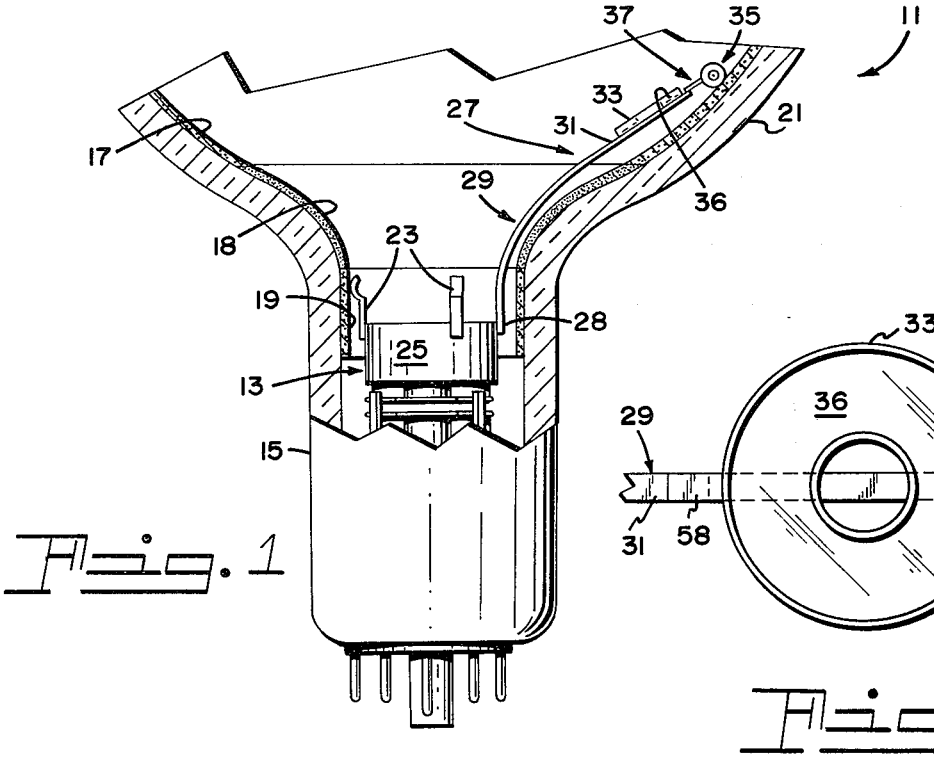
FIG. 1 is a partially sectioned view of a cathode ray tube illustrating the positioning of the invention therein.

With reference to the drawings, FIG. 1 illustrates a partially sectioned view of a cathode ray tube 11 wherein a multi-electrode electron gun structure 13 is oriented within the neck portion 15 of the tube envelope in a manner to project at least one beam of electrons to selectively impinge a panel-disposed cathodoluminescent screen, not shown. In the exemplary tube illustrated three electrically related coatings 17, 18, and 19 are areally disposed on the interior surface of the funnel portion 21 of the tube envelope, with one of the coatings 19 extending into the forward region of the neck portion 15, whereat electrical connection is made with several snubber means 23 oriented on the terminal electrode 25 of the electron gun structure 13. In this instance, three distinctive electrical coatings 17, 18 and 19 may be, for example, a conductive coating 17, a resistive coating 18, and a conductive coating 19.

As shown, an antenna-type getter structure 27 is affixed to the forward end of the gun assembly 13. This getter structure per se, includes a longitudinal positioning member or wand 29 formed as a curved resilient member having a first end 28 attached to the electron gun and an opposed second end 31 whereat a container 33 of effusive gettering material is affixed substantially terminally thereon, and wherefrom the improved support means 35 of the invention is oriented. The illustrated exemplary container is of the annular open-channel type incorporating an effusive getter material 36 therein which is subsequently activated during tube processing. While not shown, it is preferable that the container has directional shielding means incorporated therewith to substantially direct the effusion of material away from the container supportive structure and the proximally related resistive coating.

Figure 2:
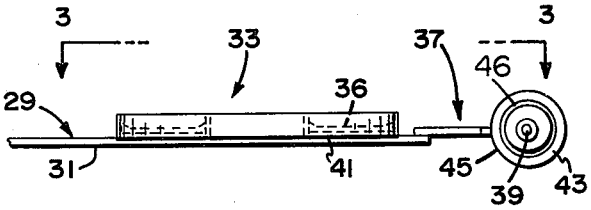
FIG. 2 is an enlarged sectional view detailing an exemplary container of effusive material and associated support means of the invention.
Figure 3:
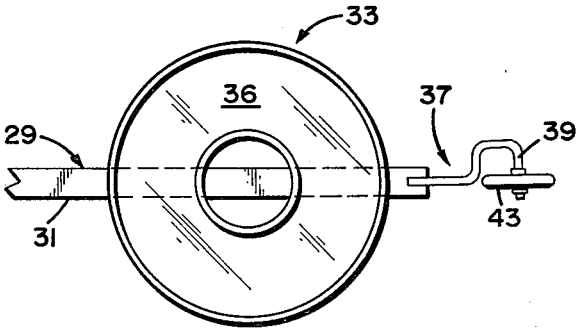
FIG. 3 is a plan view of the exemplary container and associated support means taken along the line 3—3 of FIG. 2.

The improved supportive means, as further detailed in FIGS. 2, and 3, is comprised of at least one support placement means 37 which projects outward from the container 31 as a directional continuation of the positioning member 29. This placement means has a rod-like axle portion 39 formed normal to the directional orientation of the positioning member 29, and is located in a plane related to the bottom 41 of the container. A container support means in the form of a rotatable member 43 is positioned and retained on the axle portion 39 in a manner to turn or revolve freely thereon. This rotatable member, which in this instance is delineated substantially as a wheel-like component, has a peripheral surface 45 which tracks on the interior surface of the tube or coatings thereon, in a direction common with the directional trend of the positioning member. It is preferable that the peripheral tracking surface 45 of the rotatable member 43 be of substantially arcuate or rounded contour. Such shaping eliminates abrasive sharpness of the peripheral edge and minimizes areal contact between the rotatable member and the surface or coatings on the neck 15 and funnel 21 portions of the envelope. Accordingly, the rotatable member effects facile and positive spatial supportive placement of the getter container relative to the wall of the envelope. In the exemplary embodiment shown, the getter structure 27 effectively bridges the band of resistive coating 18. In this instance, the rotatable member is formed of an insulative material such as ceramic or glass. Thus, the getter structure is electrically isolated from the respective coatings. As exemplarily shown in FIG. 2, the insulative rotatable member 43 may incorporate one or more concentric grooves or channels 46 discretely formed as substantially continuous "U" or "V" shaped indentations in one or both faces thereof, to inhibit the possibility of leakage thereacross.

If for some reason in tube construction, it is desired to effect electrical conductivity between the getter structure and a funnel disposed coating, the rotatable member would be formed of an electrical conductive material, such as a suitable metal.

Figure 4:
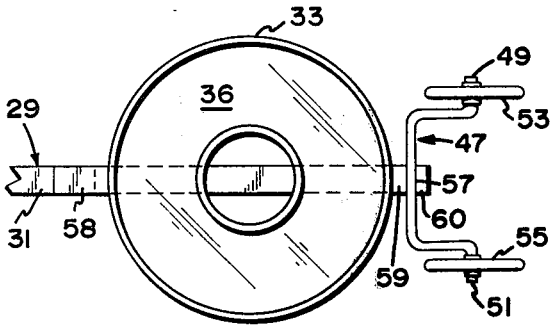
FIG. 4 is a plan view illustrating another embodiment of the invention.

Another embodiment of the invention is shown in FIG. 4 wherein the getter container 33 is affixed to a base member 59 having a first end 58 attached to the terminal end 31 of the positioning member 29. Oriented at the forward or second end 60 of the base member is the support placement means 47, which in this instance is substantially center attached, as at 57, and formed to provide two opposed axle portions 49 and 51. A pair of rotatable members, such as wheel-like elements, 53 and 55 are positioned in a spaced-apart manner on the respective axles in a manner to turn freely thereon. This type of dual support means effects added stability in placement of the container within the envelope.

Figure 5:
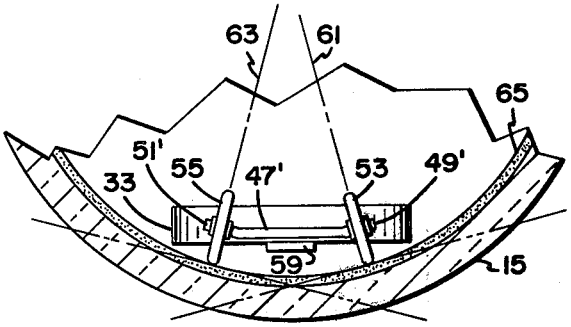
FIG. 5 delineates a modification of the embodiment shown in FIG. 4 wherein the rotatable members are canted relative to the sidewall of the neck portion.

A modification of the embodiment illustrated in FIG. 4 is shown in FIG. 5 wherein the support placement means 47' is delineated during transit through the neck portion 15. In this embodiment, each of the axle portions 49' and 51' is angled in a similar manner to provide a cant to each of the rotatable members 53 and 55, whereof the planes of rotations 61 and 63 of the respective rotatable members are substantially radially related to the interior curvature 64 of the neck portion 15. Such cantage of the dual rotatable members provides trackage substantially normal to the interior surface 65 thereby minimizing tracking area and abrasive contact while transiting the neck portion and entering the funnel region.

Figure 6:
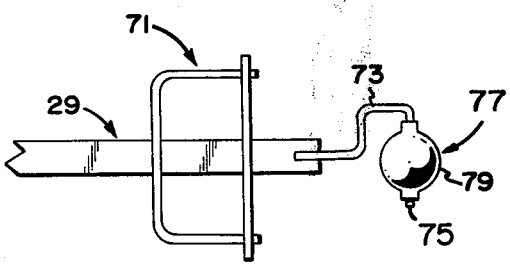
FIG. 6 is a plan view of an additional embodiment of the invention.

For an additional embodiment of the invention, attention is directed to FIG. 6 wherein an exemplary conventional looptype getter 71 is employed, such being terminally attached, for example, on the positioning member 29. The support placement means 73, in this modification, has a longer axle portion 75 to accommodate a substantially spherical-related rotatable member 77 thereon. The longer axial support of this type of rotatable member enhances accuracy of rotation, and it is within the concept of the invention to modify the peripheral surface 79 of the rotatable member to provide the degree of tracking area desired.

Thus, there is provided an improved means for supporting a container of effusive material within a cathode ray tube that minimizes abrasion of the coatings on the interior surface of the tube during positioning therein. The support means of the invention also provides insulative positioning of the container relative to the funnel disposed coatings.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a cathode ray tube having an envelopic enclosure formed of an integration of neck, funnel and panel portions and incorporating an electron gun structure within said neck portion in a manner oriented to beam electrons to a cathodoluminescent screen disposed on said panel portion, means for supporting a container of effusive material within substantially the funnel portion of said envelope comprising:

an antenna-type longitudinal positioning member having first and second ends, said first end being attached to said electron gun structure with the second end thereof having said container located thereat;

at least one support placement means projecting forwardly from said container as a directional continuation of said positioning member, said placement means having a rod-like axle portion formed normal to the directional orientation of said positioning member being in a plane related to the bottom of said container; and container support means in the form of a rotatable member having opposed faces positioned on said axle portion in a manner to turn freely thereon and track in a direction common with the directional trend of said positioning member, said rotatable member providing facile non-abrasive movement during tube fabrication of said container through said neck portion and into said funnel portion to effect positive and spatial supportive placement of said container relative to the wall of said funnel portion.

2. In a cathode ray tube having supportive means for an effusive container according to claim 1 wherein the funnel portion has at least one distinctive electrical coating interiorly disposed thereon, and wherein said rotatable member is formed of insulative material to electrically isolate the container and positioning structure from said funnel disposed coating.

3. In a cathode ray tube having supportive means for an effusive container according to claim 1 wherein the funnel portion has at least one distinctive electrical coating disposed thereon, and wherein said rotatable member is formed of conductive material to effect electrical conductivity between said funnel coating and said container and positioning structure.

4. The improved means for supporting a container of effusive material within a cathode ray tube according to claim 1 wherein said support placement means is related to the terminal end of said longitudinal positioning member, and wherein said rotatable member has at least one leakage inhibiting indentation concentrically formed in at least one face thereof.

5. The improved means for supporting a container of effusive material within a cathode ray tube according to claim 1 wherein said container has a base member affixed to the bottom thereof, and wherein said base member has a first end attached to said positioning member and an opposed second end whereat said support placement means is attached.

6. The improved means for supporting a container of effusive material within a cathode ray tube according to claim 1 wherein said peripheral tracking surface of said rotatable member is of substantially arcuate contour.

7. The improved means for supporting a container of effusive material within a cathode ray tube according to claim 1 wherein said support placement means accommodates a pair of rotatable members in a spaced apart manner.

8. The improved means for supporting a container of effusive material within a cathode ray tube according to claim 7 wherein each of said rotatable members is angled to provide a similar cant thereto relative to the interior surface of the envelope.

* * * * *